US007057125B1

(12) United States Patent
Tsai

(10) Patent No.: US 7,057,125 B1
(45) Date of Patent: Jun. 6, 2006

(54) BACKLIGHTING KEYBOARD

(76) Inventor: Huo-Lu Tsai, No. 188-1, Jhongjheng Rd., Shangfeng Village, Daya Hsiang, Taichung Hsien (TW)

( * ) Notice: Subject to any disclaimer, the term of this patent is extended or adjusted under 35 U.S.C. 154(b) by 0 days.

(21) Appl. No.: 11/145,868

(22) Filed: Jun. 6, 2005

(51) Int. Cl.
*H01H 9/00* (2006.01)

(52) U.S. Cl. ..... 200/310; 200/5 A; 362/85; 341/22

(58) Field of Classification Search ..... 200/344, 200/341, 310–314, 5 A, 5 R; 362/85, 23, 362/24; 341/22–24
See application file for complete search history.

(56) References Cited

U.S. PATENT DOCUMENTS 4,387,127 A * 6/1983 Ogden ..... 428/42.3
4,772,769 A * 9/1988 Shumate ..... 200/314
5,063,484 A * 11/1991 Tanaka ..... 362/109
5,936,554 A * 8/1999 Stanek ..... 341/22
6,548,779 B1 * 4/2003 Takahashi et al. ..... 200/516
6,575,586 B1 * 6/2003 Tsau ..... 362/85

* cited by examiner

*Primary Examiner*—K. Lee
(74) *Attorney, Agent, or Firm*—Alan D. Kamrath; Nikolai & Mersereau, P.A.

(57) ABSTRACT

A backlighting keyboard includes a light guide board with multiple fastening members formed at an upper surface, multiple light refracting areas formed at a bottom surface, multiple openings defined through the light guide board, and multiple illuminants respectively received in the openings. A membrane printed circuit board on the light guide board has multiple nodes respectively aligned with the fastening members, and multiple first holes defined through the membrane printed circuit board. A rubber button sheet on the membrane printed circuit board has multiple buttons respectively aligned with the nodes, and multiple second holes defined through the rubber button sheet. Multiple bridges are respectively and pivotally mounted on the fastening members of the light guide board. Multiple keys are respectively and pivotally mounted on the bridges.

11 Claims, 6 Drawing Sheets

BACKLIGHTING KEYBOARD

BACKGROUND OF THE INVENTION

1. Field of the Invention

The present invention relates to a keyboard for computers, and more particularly to a backlighting keyboard with a compact structure.

2. Description of Related Art

A keyboard for computers is generally provided with a backlight source so that it may be used in a low-light environment.

With reference to FIG. 6, a conventional backlighting keyboard has a metal substrate (80) made by means of a punching process. The metal substrate (80) has multiple pairs of L-like first lugs (81) and multiple pairs of second lugs (82) corresponding to keys (not shown).

A membrane printed circuit board (83) is disposed on the metal substrate (80), and a rubber button sheet (84) is disposed on the membrane printed circuit board (83). The membrane printed circuit board (83) has multiple nodes (831) corresponding to the keys. Multiple rubber buttons (841) are formed on the sheet (84) and respectively aligned with the nodes (831). The first lugs (81) and second lugs (82) in turn extend through the membrane printed circuit board (83) and rubber button sheet (84). Each of the keys is pivotally mounted on the respective first lug (81) and second lug (82) by a bridge (not shown). The rubber buttons (841) respectively abut the keys.

A light guide board (85), an illuminating board (86), and a bottom plate (87) are in turn provided beneath the substrate (80). The light guide board (85) has a light refracting area (851) formed at a bottom surface thereof. A backlight source being composed of multiple illuminants (861) is provided on the illuminating board (86). The bottom plate (87) is made of metal to stably support the illuminating board (86), light guide board (85), substrate (80), printed circuit board (83), and the rubber button sheet (84).

In use, backlights are emitted by the illuminants (861) and refracted by the light refracting area (851) to illuminate the keys so as to use the keyboard in a dark surrounding.

However, the conventional keyboard has some shortcomings as follows:

1. The substrate (80) is a thin metal sheet with multiple holes for backlights to pass through, so the substrate (80) has a low strength and may be easily deformed to become a wave-like shape during assembly and transporting.

2. In a case of the substrate (80) being deformed as a wave-like shape, the rubber buttons (841) cannot sensitively touch the nodes (831) when they are pressed downwards.

3. Because the substrate (80) is slidable about the light guide board (85), the light guide board (85) may be damaged by the friction between the substrate (80) and the light guide board (85).

Therefore, the invention provides a backlighting keyboard to mitigate or obviate the aforementioned problems.

SUMMARY OF THE INVENTION

The main objective of the present invention is to provide a backlighting keyboard of compact design.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
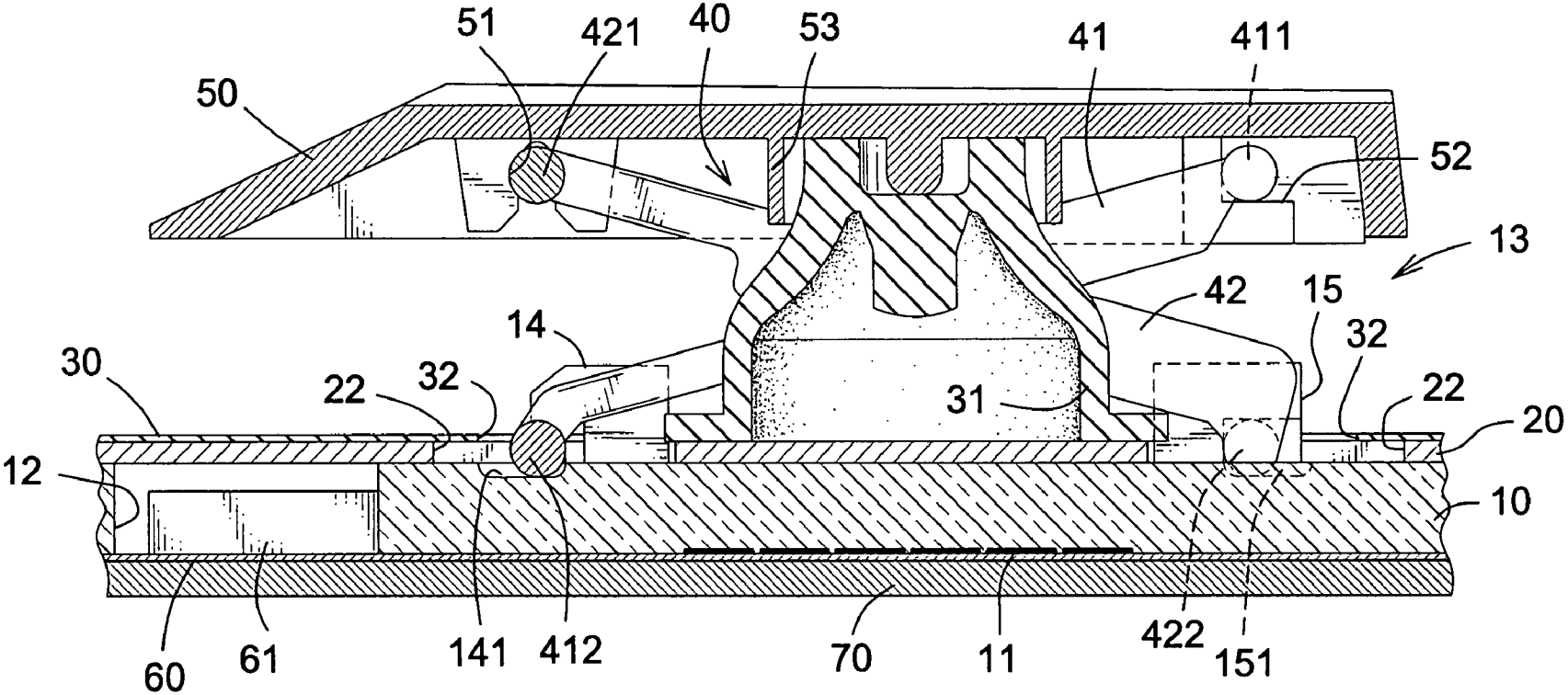
FIG. 1 is a cross sectional view of a backlighting keyboard in accordance with the present invention.
Figure 2:
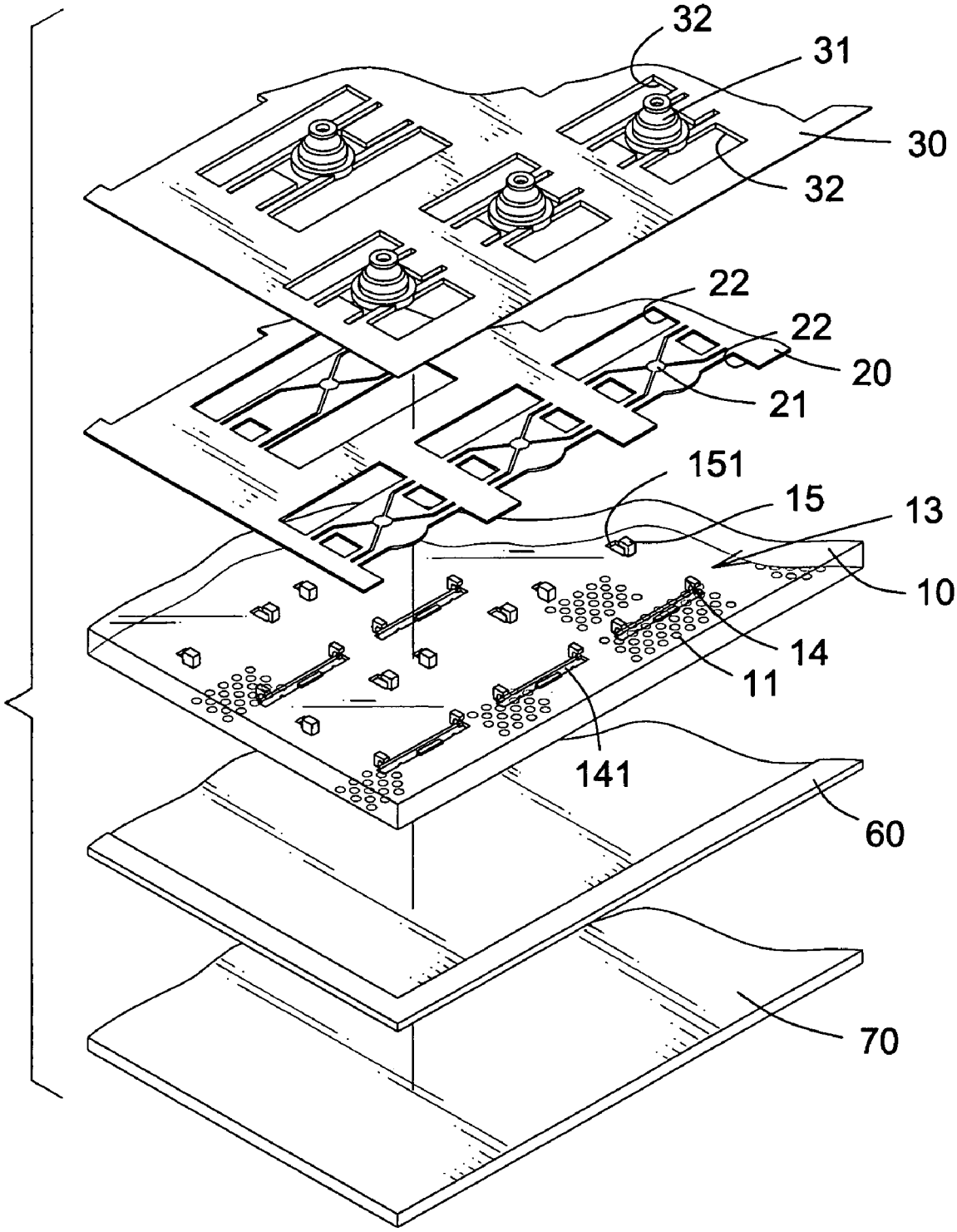
FIG. 2 is an exploded perspective view of the backlighting keyboard in FIG. 1.
Figure 3:
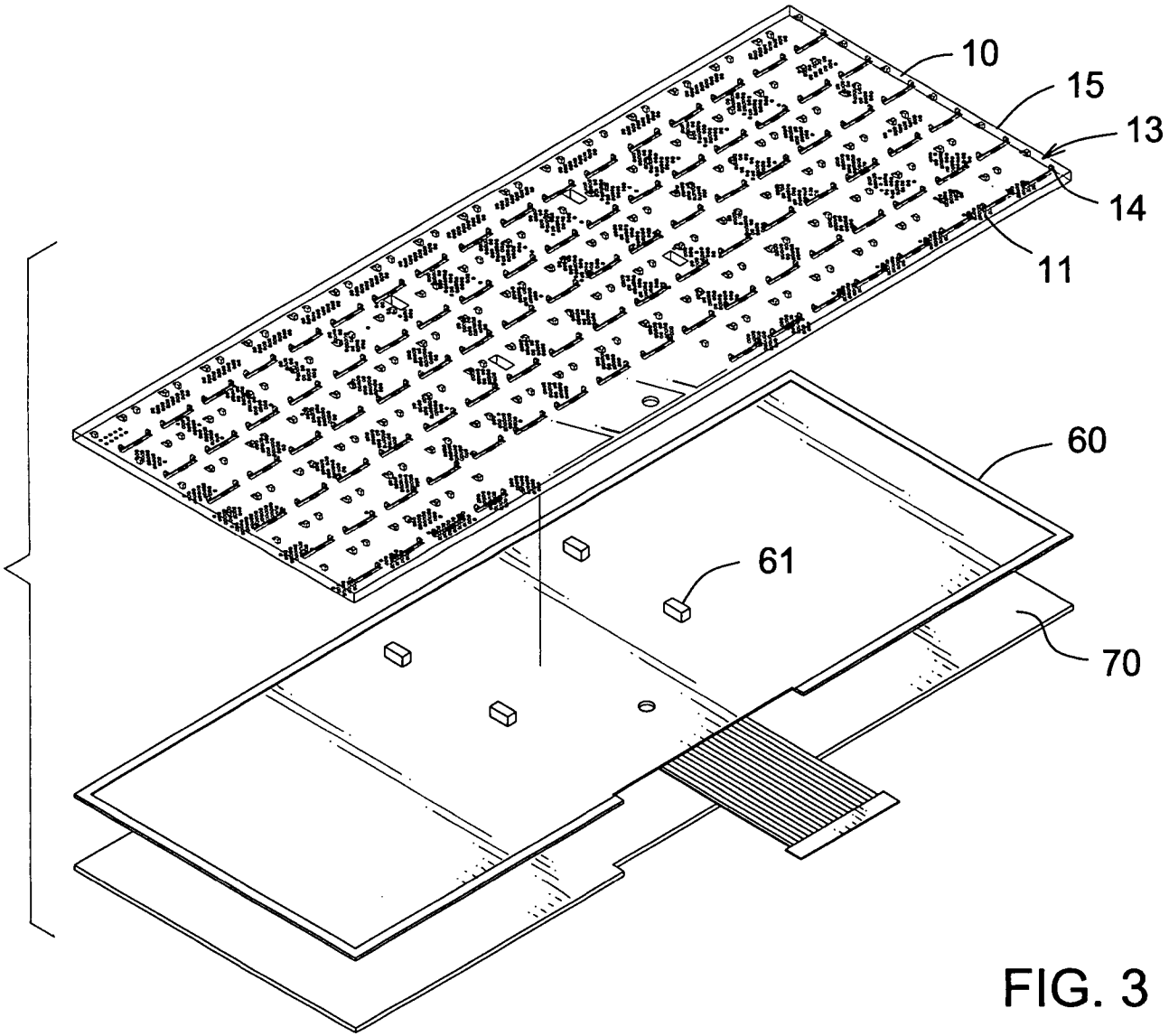
FIG. 3 is an exploded perspective view of a part of the backlighting keyboard in FIG. 1.

With reference to FIGS. 1–3, a backlighting keyboard in accordance with the present invention has a light guide board (10), a membrane printed circuit board (20), a rubber button sheet (30), a plurality of bridges (40), a plurality of keys (50), an illuminating board (60) and a bottom plate (70).

The light guide board (10) is a rectangular transparent board which has multiple light refracting areas (11) formed at a bottom surface thereof. Four openings (12) are defined at a central portion of the light guide board (10). Multiple fastening members (13) are formed on an upper surface of the light guide board (10) and each include a pair of L-like first lugs (14) and a pair of second lugs (15). The L-like first lugs (14) each have a notch away from the respective second lugs (15). A first elongated slot (141) is defined between each pair of first lugs (14), and each of the second lugs (15) has a first aperture (151) defined at a side thereof away from the first lugs (14).

The membrane printed circuit board (20) has a plurality of nodes (21) respectively aligned with the fastening members (13). Multiple first holes (22) are defined through the membrane printed circuit board (20) and respectively aligned with the first elongated slot (141) and first apertures (151). Thus, the first lugs (14) and second lugs (15) extend through the first holes (22).

The rubber button sheet (30) is provided on the membrane printed circuit board (20). Multiple buttons (31) are integrally formed on the rubber button sheet (30) and respectively aligned with the nodes (21). Multiple second holes (32) are defined through the rubber button sheet (30) and respectively aligned with the first holes (22). Thus, the first lugs (14) and second lugs (15) extend through the second holes (32).

The bridges (40) each have a first arm (41) and a second arm (42) pivotally mounted together in a scissors-like manner. The first arm (41) has a pair of first pins (411) provided at an upper end thereof. A first axle (421) is provided at an upper end of the second arm (42). A pair of second pins (422) is provided at a lower end of the second arm (42), and a second axle (412) is provided at a lower end of the first arm (41). The second pins (422) are respectively and rotatably located in the first apertures (151) of the fastening member (13), and the second axle (412) is rotatably located in the first elongated slot (141) of the same fastening member (13).

The keys (50) are made of a transparent material and each have a second elongated slot (51) and two second apertures (52) defined in a bottom surface thereof. The first pins (411)

are rotatably located in the second apertures (52), and the first axle (421) is rotatably located in the second elongated slot (51). A positioning portion (53) is formed at the bottom surface of each key (50). Each button (31) is located in the respective positioning portion (53). Thus, the key (50) is pivotally mounted on the bridge (40).

The illuminating board (60) is made of a polyester film and pasted at a bottom surface of the light guide board (10). Four illuminants (61) are provided on the illuminating board (60) and respectively received in the openings (12) of the light guide board (10). In this embodiment, each illuminant (61) is an LED.

The bottom plate (70) is made of metal and provided beneath the illuminating board (60) for reinforcing the keyboard's strength. Of course, the keyboard of the present invention can exclude the bottom plate (70).

Figure 4:
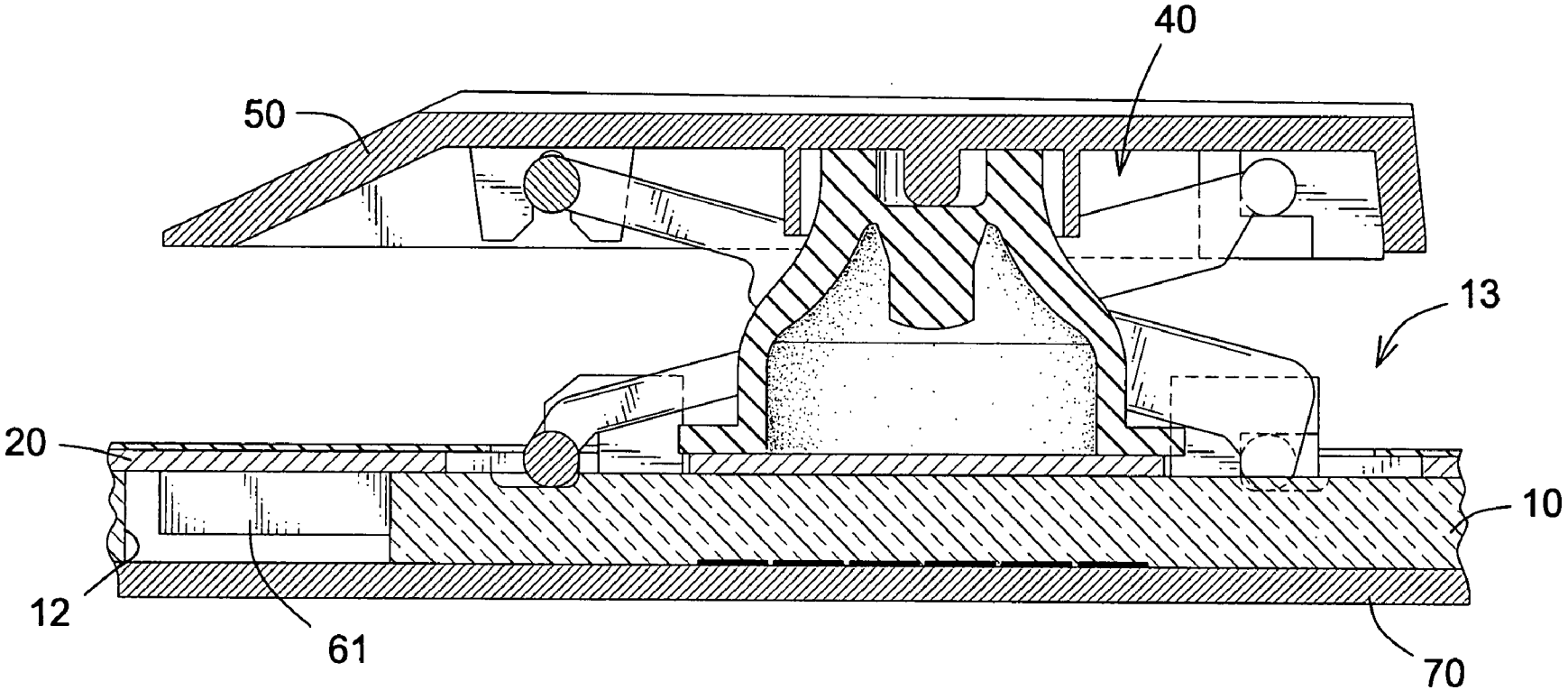
FIG. 4 is a cross sectional view of another embodiment of the backlighting keyboard in accordance with the present invention.

With reference to FIG. 4, in a second embodiment, the illuminating board (60) is eliminated, and the illuminants (61) are mounted on the bottom surface of the membrane printed circuit board (20) and received in the openings (12).

Figure 5:
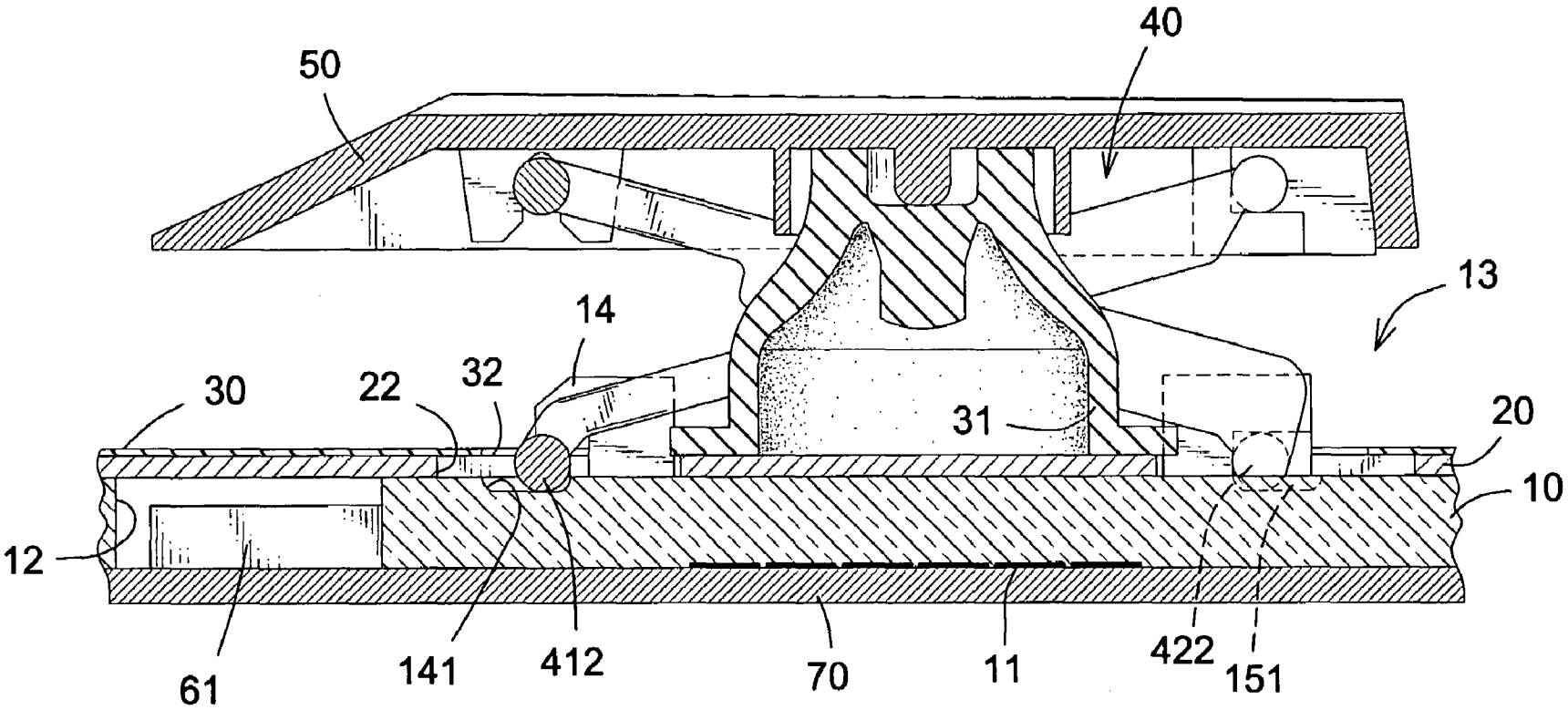
FIG. 5 is a cross sectional view of a third embodiment of the backlighting keyboard in accordance with the present invention.
Figure 6:
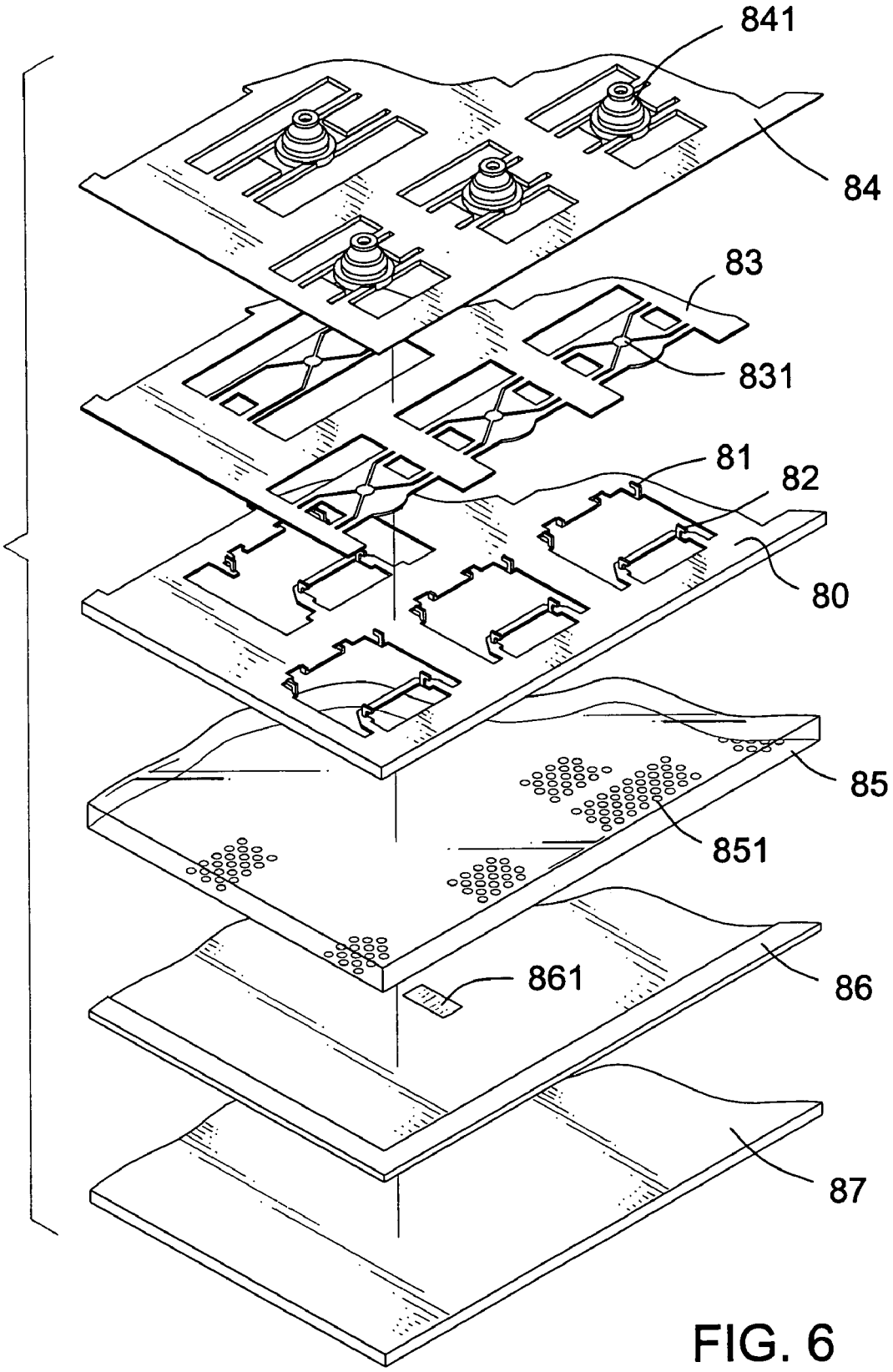
FIG. 6 PRIOR ART
FIG. 6 is an exploded perspective view of a conventional backlighting keyboard.

With reference to FIG. 5, in a third embodiment, the illuminating board (60) is eliminated, and the illuminants (61) are mounted on the bottom plate (70) and received in the openings (12).

In use, backlights are emitted by the illuminants (61) and refracted by the light refracting areas (11) to pass through the membrane printed circuit board (20), buttons (31), bridges (40) to illuminate the keys (50). Thus, the keyboard can be used in dark surroundings.

According to the present invention, because the substrate is eliminated from the keyboard, the light guide board (10) is rigid and will not be deformed during assembly and transporting. Furthermore, the rubber buttons (31) can sensitively touch the nodes (21) when they are pressed downwards.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A backlighting keyboard comprising:

a light guide board made of a transparent material and having multiple fastening members formed at an upper surface of the light guide board, multiple light refracting areas formed at a bottom surface of the light guide board, multiple openings defined through the light guide board, and multiple illuminants respectively received in the openings;

a membrane printed circuit board provided on the light guide board and having multiple nodes respectively aligned with the fastening members, and multiple first holes defined through the membrane printed circuit board;

a rubber button sheet provided on the membrane printed circuit board and having multiple buttons respectively aligned with the nodes, and multiple second holes defined through the rubber button sheet;

multiple bridges respectively and pivotally mounted on the fastening members of the light guide board, each bridge being composed of a first arm and second arm pivotally mounted together in a scissors-like manner; and multiple keys respectively and pivotally mounted on the bridges.

2. The backlight keyboard as claimed in claim 1, wherein the fastening members each have a pair of L-like first lugs and a pair of second lugs, wherein the L-like first lugs each have a notch away from the respective second lugs and a first elongated slot defined between each pair of first lugs, and each of the second lugs has a first aperture defined at a side thereof away from the first lugs; and the bridges each have a pair of first pins at an upper end of the first arm, a first axle at an upper end of the second arm, a pair of second pins at a lower end of the second arm, and a second axle at a lower end of the first arm, the second pins are respectively and rotatably located in the first apertures of the fastening member, and the second axle is rotatably located in the first elongated slot of the same fastening member.

3. The backlight keyboard as claimed in claim 2, wherein the keys each have a second elongated slot, two second apertures defined in a bottom surface thereof and a positioning portion is formed at the bottom surface of the key; and the first pins are rotatably located in the second apertures, each first axle is rotatably located in a corresponding second elongated slot, and each button is located in a corresponding positioning portion.

4. The backlight keyboard as claimed in claim 1 further comprising a illuminating board pasted at a bottom surface of the light guide board, and the illuminants are provided on the illuminating board and respectively received in the openings of the light guide board.

5. The backlight keyboard as claimed in claim 4 further comprising a bottom plate provided beneath the illuminating board.

6. The backlight keyboard as claimed in claim 1, wherein the illuminants are LEDs.

7. The backlight keyboard as claimed in claim 1, wherein the illuminants are mounted on the bottom surface of the membrane printed circuit board and received in the openings.

8. The backlight keyboard as claimed in claim 7, wherein the illuminants are LEDs.

9. The backlight keyboard as claimed in claim 1 further comprising a bottom plate provided beneath the light guide board.

10. The backlight keyboard as claimed in claim 1 further comprising a bottom plate provided beneath the light guide board, wherein the illuminants are mounted on the bottom plate and received in the openings.

11. The backlight keyboard as claimed in claim 10, wherein the illuminants are LEDs.

* * * * *